US006729496B2

(12) United States Patent
Kenny

(10) Patent No.: US 6,729,496 B2
(45) Date of Patent: May 4, 2004

(54) BEVERAGE CAN HOLDER

(76) Inventor: Roland Kenny, 675 Warsaw Avenue, Winnepeg, Manitoba (CA), R3m 1B5

( * ) Notice: Subject to any disclaimer, the term of this patent is extended or adjusted under 35 U.S.C. 154(b) by 0 days.

(21) Appl. No.: 10/241,635

(22) Filed: Sep. 12, 2002

(65) Prior Publication Data

US 2003/0075550 A1 Apr. 24, 2003

(30) Foreign Application Priority Data

Oct. 23, 2001 (CA) ..... 2359597

(51) Int. Cl.[7] ..... B65D 35/00
(52) U.S. Cl. ..... 220/742
(58) Field of Search ..... 220/737, 742, 220/320, 321; 248/311.2

(56) References Cited

U.S. PATENT DOCUMENTS 3,045,857 A * 7/1962 Lineweber ..... 220/4.16
3,719,305 A * 3/1973 Pressnell ..... 220/740
3,979,011 A * 9/1976 Schleicher ..... 220/742
4,069,997 A * 1/1978 Weiss ..... 248/553
4,602,723 A 7/1986 DeMars
4,671,424 A 6/1987 Byrns
4,989,743 A * 2/1991 Lowery ..... 220/737
4,993,675 A 2/1991 Walker
5,203,471 A 4/1993 Widman
5,261,554 A 11/1993 Forbes
5,505,330 A 4/1996 Nunes
5,664,718 A 9/1997 Vine
D392,081 S * 3/1998 Salvucci, Sr.
5,839,602 A * 11/1998 Mowry ..... 220/737
6,059,245 A * 5/2000 Hermansen et al. ..... 248/311.2
6,260,732 B1 * 7/2001 Khodush ..... 220/737

* cited by examiner

*Primary Examiner*—Joseph Man-Fu Moy
(74) *Attorney, Agent, or Firm*—Ryan W. Dupuis; Adrian D. Battison; Michael R. Williams

(57) ABSTRACT

A holder is provided having a receptacle which is suitably sized and arranged for slidably receiving a cylindrical beverage can therein. A handle is coupled to the receptacle to extend generally in a longitudinal direction of the receptacle spaced radially outwardly from the receptacle. A lock mechanism on the receptacle is arranged to restrict both rotation and sliding movement in a longitudinal direction of the receptacle of the cylindrical beverage can in relation to the receptacle.

15 Claims, 3 Drawing Sheets

BEVERAGE CAN HOLDER

FIELD OF THE INVENTION

The present invention relates to a holder for supporting a cylindrical beverage can.

BACKGROUND

Beverages are commonly available in disposable aluminium cans and the like for convenience and ease of distribution. Some individuals however find that cylindrical-type beverage cans are awkward to grasp, especially when the cans are king size or jumbo size cans typically available for distribution of beer. As many beverages are often chilled, grasping the can may also be uncomfortable due to the cold temperature of the can and beverage therein. Also some individuals may find that grasping the can in one's hand causes the drink to become warm too quickly. When serving beverages from a can it is thus known to dispense the contents of the can into a mug or similar container for consuming the beverage therefrom. Dispensing the can into an additional container however can be a time consuming annoyance.

The use of handles for securement to the beverage can for holding the can while consuming the contents is known for solving some of the above noted problems. Examples of various handles for beverage cans can be found in U.S. Pat. No, 4,602,723 to Demars, U.S. Pat. No. 5,505,330 to Nunes, U.S. Pat. No. 4,993,675 to Walker, U.S. Pat. No. 5,203,471 to Widman and U.S. Pat. No. 5,664,718 to Vine. None of these can holders however provide suitable support to the sides of the can, thus relying on the strength of a small retainer clip for securing the holder to the can in an unstable arrangement. Also with regard to the above noted patents, rotation of the beverage can with respect to the holder is permitted so that the handle of the holder may lie at an awkward orientation in relation to a mouth of the can.

SUMMARY

According to one aspect of the present invention there is provided a holder for supporting a cylindrical beverage can, the holder comprising:

- a receptacle which is suitably sized and arranged for slidably receiving a cylindrical beverage can therein;
- a handle coupled to the receptacle to extend generally in a longitudinal direction of the receptacle spaced radially outwardly from the receptacle; and
- a lock mechanism for restricting relative rotation between the receptacle and a cylindrical beverage can supported within the receptacle.

The use of a lock mechanism ensures that the handle is well supported on the beverage can without any relative movement therebetween. Preventing relative rotation is especially desirable as it ensures that the mouth of the beverage can remains fixed at a selected orientation in relation to the handle of the holder.

The lock mechanism is preferably arranged to restrict both relative rotation and relative sliding movement in a longitudinal direction of the receptacle between the receptacle and a cylindrical beverage can supported within the receptacle.

The lock mechanism may comprise a movable lock member which is arranged to project inwardly past an inner peripheral surface of the receptacle in a locked position for engaging a cylindrical beverage can supported within the receptacle.

The lock mechanism may include a lever coupled to the lock member for movement therewith. The lever is preferably curved and arranged to extend partway about the receptacle in the locked position.

The lock mechanism may comprise a cam pivotally mounted on the receptacle, the cam having an increasing radial dimension for movement as the cam is rotated between a locked position in which the cam projects inwardly past an inner peripheral surface of the receptacle and an unlocked position in which the cam does not project inwardly past the inner peripheral surface of the receptacle.

The lock mechanism may be supported on the receptacle adjacent an open top end of the receptacle which is arranged to receive a cylindrical beverage can therethrough.

The handle is preferably coupled to the receptacle at both ends of the handle.

The receptacle may comprise an elongate sleeve structure having an open top end for receiving a can therethrough. The sleeve structure preferably includes an enclosed bottom end for supporting the can thereon.

The sleeve structure may also include a pair of label openings on diametrically opposed sides thereof arranged to expose respective labels on a can supported within the sleeve structure.

The sleeve structure may extend substantially a full length of a conventional cylindrical beverage can while encircling respective top and bottom ends of the can supported within the sleeve structure.

Preferably the sleeve structure comprises an upper ring, a lower ring and at least one structural member spanning between the upper and lower rings.

The receptacle may include a recessed portion adjacent an open top end which is spaced circumferentially from the handle by approximately 90 degrees for access to a mouth of a can supported in the receptacle. Preferably there is provided a pair of the recessed portions on diametrically opposed sides of the receptacle.

The receptacle and the handle may both be formed of a flexible plastic like material. Any material which is suitable for forming the desired shape however could be used.

There may be provided a hook member coupled to the receptacle for suspending the receptacle and handle therefrom.

BRIEF DESCRIPTION OF THE DRAWINGS

In the accompanying drawings, which illustrate an exemplary embodiment of the present invention.

DETAILED DESCRIPTION

Figure 1:
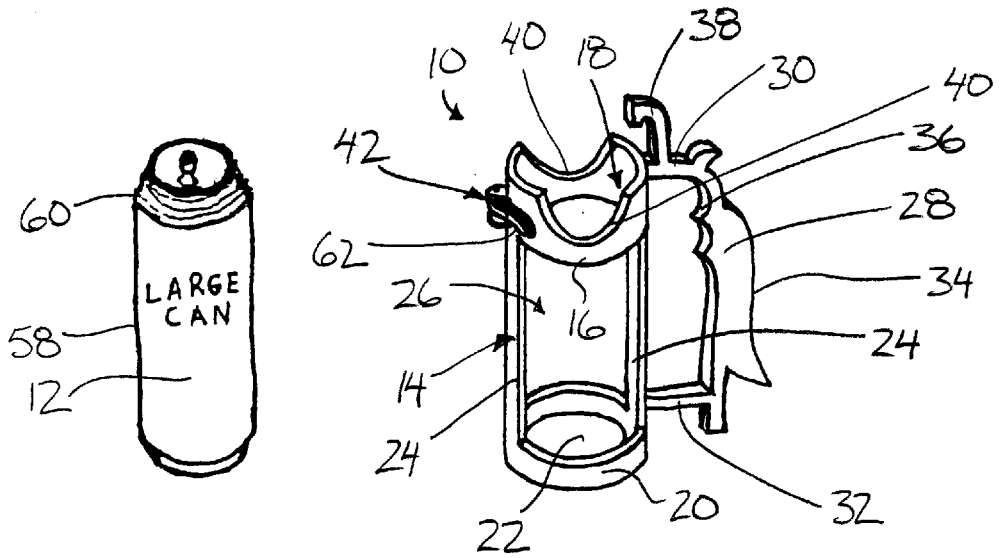
FIG. 1 is an isometric view of the holder and a beverage can shown separated from the holder.
Figure 2:
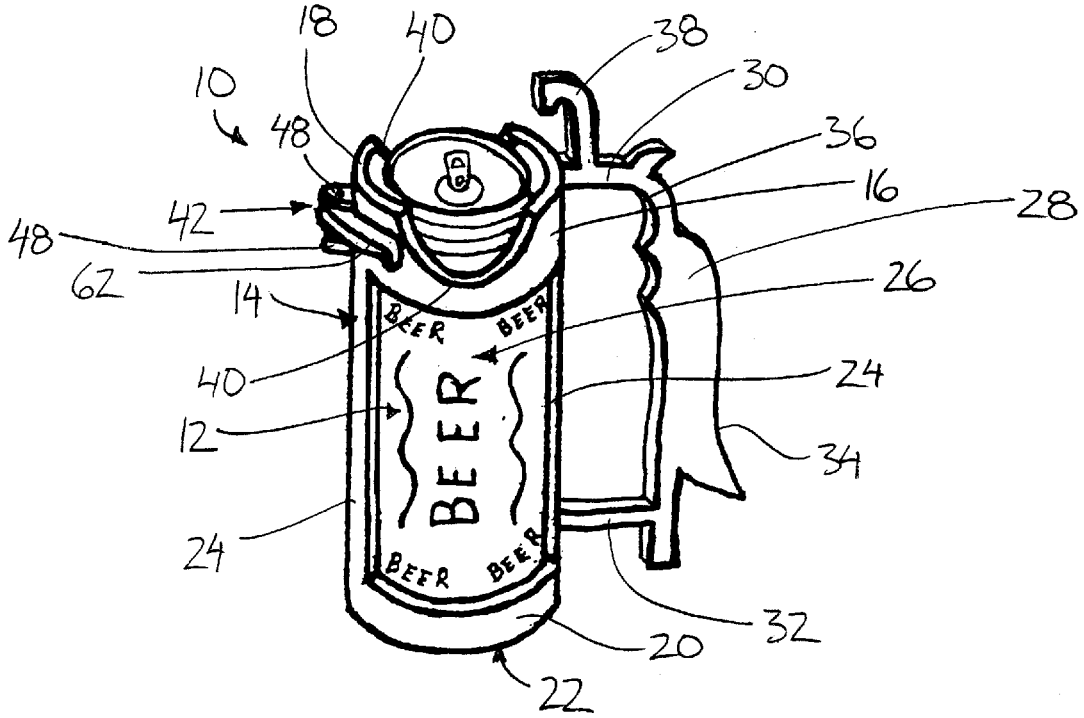
FIG. 2 is an isometric view of the holder with the beverage can shown supported therein.

Referring to the accompanying drawings, there is illustrated a holder generally indicated by reference numeral 10.

The holder is intended for supporting aluminium-type beverage cans 12, particularly jumbo cans and king size cans, for assisting individuals in grasping the can.

The holder 10 includes a receptacle 14 in the form of an elongate sleeve structure suitably sized for slidably receiving the can 12 therein. An interior diameter of the receptacle 14 is approximately equal to the outer diameter of a conventional beverage can, while the length of the receptacle extends substantially the full length of a conventional can.

The receptacle includes an upper ring 16 which encircles a top end of the can 12 and defines an open top end of the receptacle for receiving the can 12 therethrough.

A lower ring 20 is provided and arranged to encircle a bottom end of the can 12 spaced below the upper ring 16. The lower ring 20 includes an enclosed base 22 which encloses the bottom end of the receptacle for supporting the can 12 thereon.

The upper and lower rings 16 and 20 are held at a fixed spacing in use by a pair of diametrically opposite support members 24 which span vertically between the upper and lower rings. The support member 24 define a pair of diametrically opposed label openings 26 therebetween on opposite sides of the receptacle 14. Each label opening 26 spans substantially a whole side of the can 12 supported within the receptacle for displaying the label of the can when the can is supported in the receptacle.

A handle 28 is provided adjacent one of the support members 24 to extend along side the receptacle 14 in the longitudinal direction of the receptacle spaced radially outwardly therefrom. The handle 28 is coupled at a top end 30 to the upper ring 16 and at a bottom end 32 to the lower ring 20. At the top end 30 the handle 28 is coupled to the upper ring 16 adjacent the open top end 18 of the receptacle for stability when tilting the can for pouring or consuming the beverage within a can.

The handle 28 includes a gradually curved outer side 34 which is arranged to conform to the shape of the palm of a person's hand, while the inner side 36 of the handle 28 includes a plurality of finger grooves for receiving individual fingers of the person's hand therein. A hook 38 is coupled to the top end 30 of the handle to extend upwardly therefrom to a free end which is curved downwardly for suspending the receptacle and the handle therefrom.

A pair of recessed mouth portions 40 are provided on diametrically opposite sides of the upper ring 16 for permitting access to the mouth of the can 12 in a top side thereof. Each recessed mouth portion 40 comprises a curved recess which is cut into the top edge of the upper ring 16 about the open top end of the receptacle. The recessed mouth portions 40 are spaced circumferentially approximately 90° from opposing sides of the handle 28 when viewed from above so that the mouth of the can may be conveniently located and accessed regardless of whether a person using the holder is right-handed or left-handed.

A lock mechanism 42 is provided in the upper ring 16 for securing the can 12 within the receptacle 14. The lock mechanism 42 is arranged to selectively engage the can 12 within the receptacle 14 for anchoring the can against rotation in relation to the holder as well as anchoring the can against vertical sliding movement in and out of the receptacles of the holder. Once a can is inserted into the receptacle and the lock mechanism 42 is engaged, the mouth of the can remains at a fixed orientation in relation to the handle 28 of the holder for ease of drinking from the can.

The locking mechanism 42 is located in the upper ring 16 adjacent the open top end of the receptacle and opposite the handle 28. The lock mechanism 42 communicates through an opening 44 in the upper ring 16 opposite the handle 28 which is arranged to be in alignment with the upper ring of a can above the side walls of the can. The opening 44 is arranged to receive a movable locking member therethrough which selectively engages the can for anchoring the can within the receptacle 14.

The lock member comprises a cam 46 which is mounted on the upper ring 16 for pivotal movement about a vertical axis extending through a pair of cam mounts 48. The cam mounts 48 are a pair of semi-circular flanges which project horizontally outwardly from the upper ring 16 directly above and below the opening 44. A pivot pin 50 extends through both cam mounts 48 and the cam 46 therebetween for pivotally supporting the cam 46 about a longitudinal axis of the pivot pin.

Figure 3:
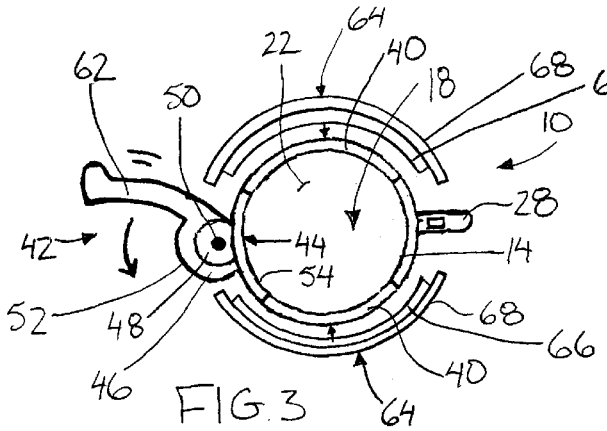
FIG. 3 is a top plan view of the holder with the lock mechanism shown in an unlocked position.
Figure 4:
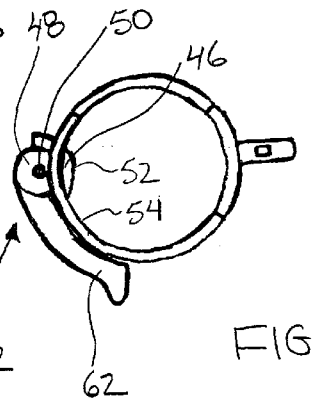
FIG. 4 is a top plan view of the holder with the lock mechanism shown in a locked position.
Figure 5:
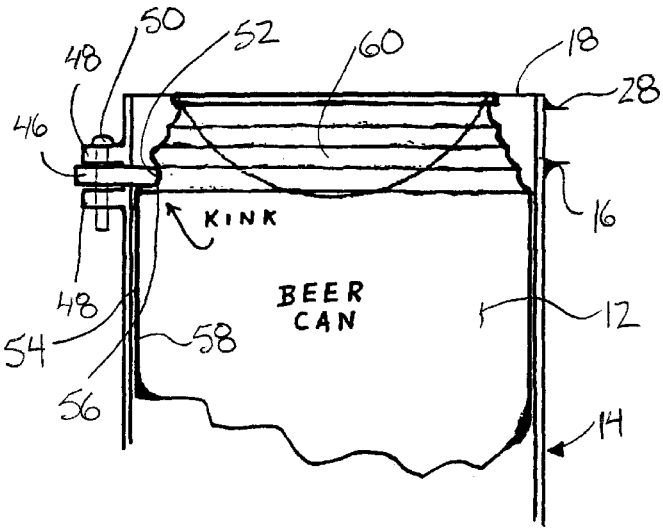
FIG. 5 is a partially sectional side elevational view of an upper portion of the holder with a beverage can shown secured therein by the lock mechanism in a locked position.
Figure 6:
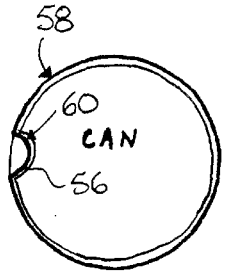
FIG. 6 is a top plan view of a beverage can shown deformed by the lock mechanism.

The cam 46 includes an engaging surface 52 which increases in radial dimension at a point of engagement with the can 12 as the cam 46 is rotated between an unlocked position as shown in FIG. 3 and a locked position as shown in FIG. 4. In the unlocked position a portion of the cam 46 having the smallest radial dimension faces the can 12 within the receptacle 14 so that the cam does not project inwardly beyond an inner peripheral surface 54 of the receptacle 14. In the locked position a portion of the cam 46 having a greater radial dimension faces inwardly towards the can 12 so as to project inwardly beyond the inner peripheral surface 54 of the receptacle and thereby protrude into the side of the can 12 for anchoring the can within the receptacle. The portion of increased radial dimension of the cam 46 engages the can 12 in the locked position in a manner so as to form a kink 56 in the side of the can at a position spaced above the side walls 58 of the can adjacent the lowermost portion of the upper ring 60 of the can. The kink 56 is illustrated in FIG. 6 in cross section as viewed from above.

A lever 62 is coupled to the cam 46 for rotation therewith in a horizontal plane between respective locked and unlocked positions. The lever 62 is curved so as to be curved part way around the outer wall of the receptacle 14 when positioned against the receptacle in the locked position. In the unlocked position the lever 62 projects radially outwardly from the receptacle.

Figure 7:
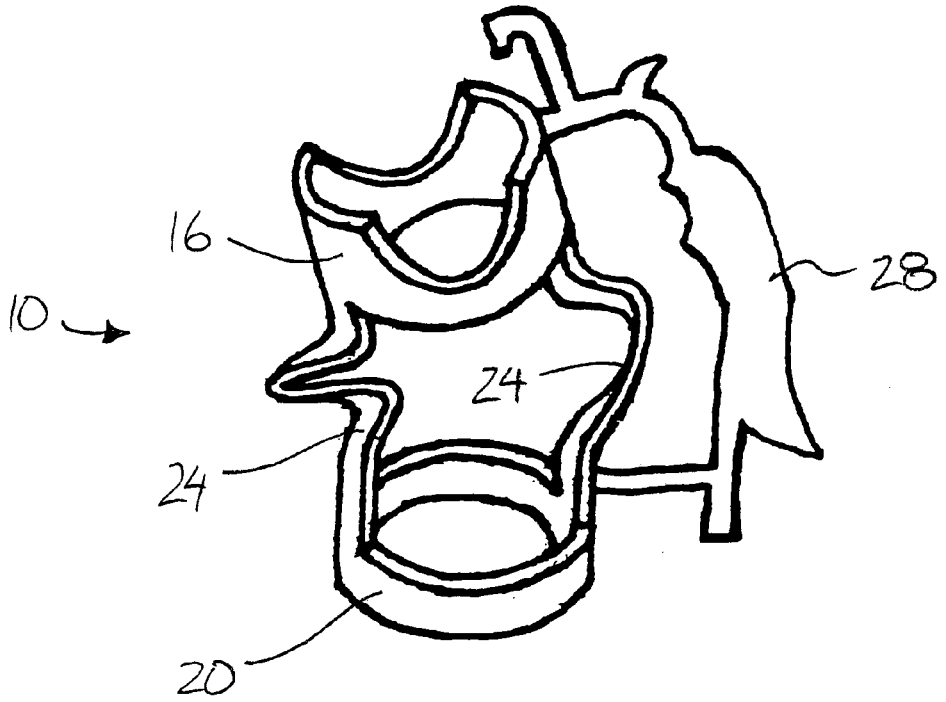
FIG. 7 is an isometric view of the holder in a partially collapsed position.

The holder 10 is preferably formed of a lightweight disposable material which is flexible so as to permit the holder to be collapsed as illustrated in FIG. 7. The inner dimensions of the receptacle 14 are formed to be substantially equal to the outer dimensions of conventional size beverage cans for snugly receiving the cans therein. To reduce weight and materials used, the components of the holder 12 have a thickness in the order of ⅛ of an inch.

The structure of the holder 10 by itself has very little compressive strength permitting the holder to be collapsed as shown in FIG. 7. Once a beverage can 12 is received within the receptacle 14 however, the can 12 provides structural integrity to the holder so that the holder becomes a rigid structure when the lock mechanism 42 is engaged with the can 12 supported within the receptacle 14.

Figure 8:
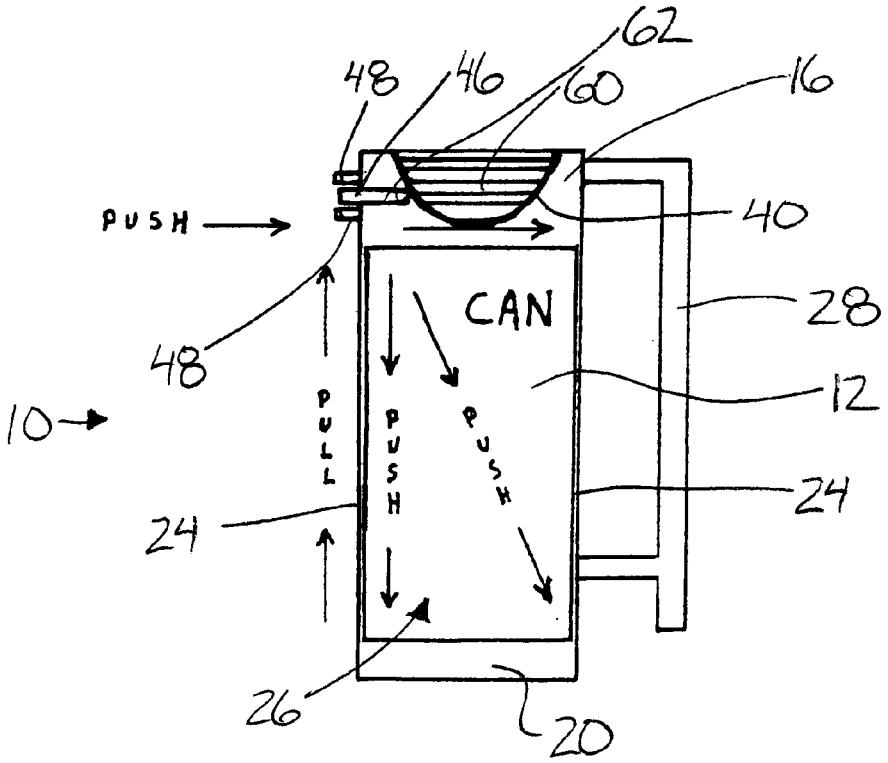
FIG. 8 is a side elevational view of the holder illustrating the forces of the lock mechanism acting on the can and the holder.

As shown by the arrows of FIG. 8, tightening the cam 46 into the locked position pulls upwardly on the upper ring 16 while pushing down on the can 12 such that the support members 24 are under tension between the upper and lower rings of the receptacle. The materials selected for the receptacle thus preferably have a reasonable tensile strength so as to provide structural integrity to the receptacle when a can 12 is supported therein. The components of the lock mechanism 42 are preferably formed of a more rigid plastic material so as to have sufficient strength to deform the beverage can when displaced between the unlocked and locked positions.

As shown in FIG. 3 a pair of insulated panels 64 may be provided for enclosing the label openings 26. Each insulated panel 64 comprises an arcuate-shaped panel which includes an inner portion 66 which fits snugly within the respective label opening 26 and an outer portion 68 which is larger in dimensions for overlapping respective side edges of the inner portion to conceal the edges of the label opening 26. The insulated panels 64 may be optionally mounted on the receptacle 14 when insulating the contents of the beverage can 12 are desired.

The use of the holder 10 permits beverages in cans to be served in a mug-like container without the need for serving personnel to pour the contents of the can from the can to a mug. Filling the mug, when the mug comprises the holder 10 with a can 12 supported therein, involves simply replacing the can 12 like changing a cartridge in a quick and efficient operation.

The thin plastic construction of the holder adds little extra weight to the can so that the mug structure is lighter than conventional mugs. The base 22 of the lower ring 20 also provides a larger and more stable support than the can 12 by itself to reduce the likelihood of the can being tipped over. The thin plastic construction also results in a mug which is of low cost and simple construction so as to be disposable and recyclable while being easily replaceable. The label openings 26 also ensure that distributors of beverages in cans can continue to have their labels displayed on the product being served to consumers.

In further embodiments, the lock mechanism may comprise any suitable mechanism for gripping the can to restrict relative displacement between the receptacle and the can, either by friction or by use of a member projecting into the can as described above. When gripping the can by friction, the lock mechanism would preferably comprise a mechanism which constricts about the can similarly to the manner in which the mechanism 62 described above constricts the can by engagement of a lever between the unlocked and locked positions. In either arrangement, the lock mechanism preferably engages the can 12 about the upper ring 60 thereof, above the side walls 58 of the can where the can tapers inwardly at a top end thereof, as the upper ring 60 is considerably more rigid when constricted than the side walls 58.

While various embodiments of the present invention have been described in the foregoing, it is to be understood that other embodiments are possible within the scope of the invention. The invention is to be considered limited solely by the scope of the appended claims.

What is claimed is:

1. A holder for supporting a cylindrical beverage can, the holder comprising:

a receptacle which is suitably sized and arranged for slidably receiving a cylindrical beverage can therein;

a handle coupled to the receptacle to extend generally in a longitudinal direction of the receptacle spaced radially outwardly from the receptacle; and a lock mechanism for restricting relative movement between the receptacle and a cylindrical beverage can supported within the receptacle;

the lock mechanism including a cam movably mounted on the receptacle, the cam having a camming surface for engagement with a can supported within the receptacle, the camming surface increasing in dimension as the cam is displaced between an unlocked position in which the camming surface does not project inwardly past the inner peripheral surface of the receptacle and a locked position in which the camming surface projects inwardly past an inner peripheral surface of the receptacle to engage the can supported therein.

2. The holder according to claim 1 wherein the lock mechanism includes a lever coupled to the lock member for movement therewith, the lever being curved and arranged to extend partway about the receptacle in the locked position.

3. The holder according to claim 1 wherein the cam is pivotally mounted on the receptacle, the camming surface having an increasing radial dimension as the cam is rotated from the unlocked position to the locked position.

4. The holder according to claim 1 wherein the lock mechanism is supported on the receptacle adjacent an open top end of the receptacle which is arranged to receive a cylindrical beverage can therethrough.

5. The holder according to claim 1 wherein the handle is coupled to the receptacle at both ends of the handle.

6. The holder according to claim 1 wherein the receptacle comprises an elongate sleeve structure having an open top end for receiving a can therethrough.

7. The holder according to claim 6 wherein the sleeve structure includes an enclosed bottom end for supporting the can thereon.

8. The holder according to claim 6 wherein the sleeve structure includes at least one label opening in a side thereof arranged to expose a label on a can supported within the sleeve structure.

9. The holder according to claim 8 wherein the sleeve structure includes a pair of the label openings on diametrically opposed sides of the sleeve structure.

10. The holder according to claim 6 wherein the sleeve structure extends substantially a full length of a conventional cylindrical beverage can.

11. The holder according to claim 6 wherein the sleeve structure is arranged to encircle respective top and bottom ends of a can supported within the sleeve structure.

12. The holder according to claim 6 wherein the sleeve structure comprises an upper ring, a lower ring and at least one structural member spanning between the upper and lower rings.

13. The holder according to claim 1 wherein the receptacle and the handle are both formed of a flexible plastic like material.

14. The holder according to claim 1 wherein there is provided a hook member coupled to the receptacle for suspending the receptacle and handle therefrom.

15. A holder for supporting a cylindrical beverage can, the holder comprising:

a receptacle which is suitably sized and arranged for slidably receiving a cylindrical beverage can therein;

a handle coupled to the receptacle to extend generally in a longitudinal direction of the receptacle spaced radially outwardly from the receptacle; and a lock mechanism for restricting relative movement between the receptacle and a cylindrical beverage can supported within the receptacle;

the lock mechanism including a cam pivotally mounted on the receptacle, the cam having a camming surface for engagement with a can supported within the receptacle, the camming surface increasing in radial dimension as the cam is rotated between an unlocked position in which the camming surface does not project inwardly past the inner peripheral surface of the receptacle and a locked position in which the camming surface projects inwardly past an inner peripheral surface of the receptacle to engage the can supported therein.

* * * * *